US009126425B2

(12) United States Patent
MacClary et al.

(10) Patent No.: US 9,126,425 B2
(45) Date of Patent: Sep. 8, 2015

(54) DUPLEX PRINTING

(75) Inventors: Matthew Alan MacClary, Corvallis, OR (US); Daniel Edgar Robin, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/391,719

(22) PCT Filed: Apr. 13, 2012

(86) PCT No.: PCT/US2012/033474

§ 371 (c)(1), (2), (4) Date: Oct. 10, 2014

(87) PCT Pub. No.: WO2013/154575

PCT Pub. Date: Oct. 17, 2013

(65) Prior Publication Data

US 2015/0070418 A1 Mar. 12, 2015

(51) Int. Cl.

| | |
|---|---|
| ***B41J 29/393*** | (2006.01) |
| ***B41J 3/60*** | (2006.01) |
| ***B41J 3/01*** | (2006.01) |
| ***B41J 11/46*** | (2006.01) |
| *B41J 29/38* | (2006.01) |

(52) U.S. Cl.

CPC .... *B41J 3/60* (2013.01); *B41J 3/01* (2013.01); *B41J 11/46* (2013.01)

(58) Field of Classification Search

CPC ..... B41J 11/42; B41J 11/46; B41J 29/393; B41J 29/38; B41J 29/387; G03G 15/23–15/238; G03G 2215/00902

USPC ..... 347/16, 19

See application file for complete search history.

(56) References Cited

U.S. PATENT DOCUMENTS

| | | | | |
|---|---|---|---|---|
| 7,103,306 | B2 * | 9/2006 | Shimizubata | 399/306 |
| 7,245,856 | B2 | 7/2007 | Furst et al. | |
| 8,753,026 | B2 * | 6/2014 | Haan et al. | 400/76 |
| 8,917,903 | B2 * | 12/2014 | Yamakawa | 382/100 |

(Continued)

FOREIGN PATENT DOCUMENTS

| | | |
|---|---|---|
| JP | 10-202988 | 8/1998 |
| JP | 2006-327072 | 12/2006 |

(Continued)

OTHER PUBLICATIONS

Korean Intellectual Property Office, Notification of Transmittal of the International Search Report and the Written Opinion of the International Searching Authority, or the Declaration mailed Dec. 26, 2012 (8 pages).

*Primary Examiner* — Jannelle M Lebron
*Assistant Examiner* — Jeremy Bishop

(57) ABSTRACT

According to one example, there is provided a method of duplex printing. The method comprises printing recto pages and associated recto checkmarks on a first side of a web and printing verso pages and associated verso checkmarks on a second side of a web, the length of each successively printed recto and verso checkmark varying in accordance with a respective recto and verso checkmark length sequence, determining the length of successive printed verso and recto checkmarks and determining their sequence position in the appropriate checkmark length sequence, and determining whether a print error has occurred based on the determined recto and verso checkmark sequence positions.

14 Claims, 7 Drawing Sheets

(56) References Cited

U.S. PATENT DOCUMENTS

| | | | | |
|---|---|---|---|---|
| 2005/0286915 | A1* | 12/2005 | Butikofer | 399/16 |
| 2006/0039015 | A1* | 2/2006 | Kageyama et al. | 358/1.5 |
| 2009/0060606 | A1* | 3/2009 | Rawlings et al. | 399/364 |
| 2010/0329756 | A1 | 12/2010 | Mizes | |
| 2011/0211006 | A1 | 9/2011 | Ochiai | |
| 2012/0033264 | A1 | 2/2012 | Sagan et al. | |

FOREIGN PATENT DOCUMENTS

| | | | |
|---|---|---|---|
| JP | 2010-284884 | | 12/2010 |
| JP | 2011183803 | | 9/2011 |
| JP | 2013158997 | A * | 8/2013 |

* cited by examiner

DUPLEX PRINTING

CROSS-REFERENCE TO RELATED APPLICATION

This application is a national stage application under 35 U.S.C. §371 of PCT/US2012/033474, filed 13 Apr. 2012, which is hereby incorporated by reference.

BACKGROUND

Many industrial printing systems are able to print on both sides of a web or roll of media. Some duplex web printing systems, such as high-speed printing systems, may use one print engine for printing on one side of a web, and a second print engine for printing on the reverse side of a web.

When printing on both sides of a web it is important that pages printed on each side of the web are not only correctly aligned opposite one another, but also that the correct printed page is printed on each side of the web. This ensures that when the web is cut into individual sheets the pages on each side of each sheet correspond. For example, when printing double-sided personalized correspondence, such as bank statements, medical records, salary statements, etc., it is critical that the recto and the verso pages of each sheet of media correspond to the same individual.

BRIEF DESCRIPTION

Examples, or embodiments, of the invention will now be described, by way of non-limiting example only, with reference to the accompanying drawings, in which.

DETAILED DESCRIPTION

One way to help ensure synchronization of duplex print engines is to print a barcode along with each printed page, for example along one edge of the web next to each printed page. However, as the speed of high-speed printing systems increases, the time it takes to read a barcode, to decode it, and to determine whether a page has been printed at the correct position on a web becomes a limiting factor. Furthermore, reading of barcodes typically requires specialized, and generally costly, equipment such as laser scanners, optical elements, and the like.

Various examples will now be described that provide a printing system that includes a simple and high-speed verification system to determine whether pages printed on two sides of a web are printed as intended.

Figure 1:
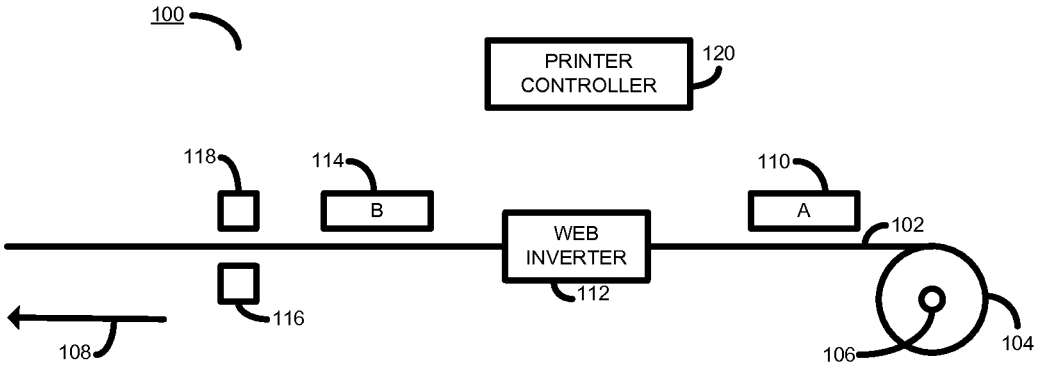
FIG. 1 is a simplified block diagram of a printing system according to one example.

Referring now to FIG. 1, there shown a simplified illustration of a printing system 100 according to one example. It will be appreciated that for clarity not all elements of a typical printing system are shown. In one example the printing system 100 is a high-speed printing system capable of printing on hundreds of meters of web per minute.

The printing system 100 is a web-based printer that prints on media or substrate 102 that is provided on a web or roll of media 104. The web 104 is installed on a spindle 106. The printing system comprises a first print engine 110 for printing on a first side of the web 102, a web inverter 112 for inverting the web, a second print engine 114 for printing on a second side of the web 102, and a pair of checkmark readers 116 and 118, positioned on either side of the web. The operation of elements of the printing system is controlled by a printer controller 120.

The media 102 feeds through the printing system 100 through a media path in a media advance direction 108. The printing system 100 may include media handling devices (not shown), such as powered rollers, to move the media 102 through the media path of the printing system 100.

In the present example the first and second print engines 110 and 114 are inkjet print engines that include one or multiple inkjet printheads that eject ink drops onto the media 102. In the present example the first and second print engines are configured in a page-wide array arrangement, in which one or multiple inkjet printheads span substantially the whole width of the media 102. In this way, the media 102 may be advanced in a continuous manner in the media advance direction 108 whilst printing is performed.

In other examples the first and second print engines may use other printing techniques, such as liquid electro-photographic (LEP) techniques, dry toner techniques, or the like. In other examples the media may be advanced in an incremental manner.

In one example the second print engine 114 may be configured to print directly on the underside of the web 102, thereby removing the need for the web inverter 112.

Figure 2:
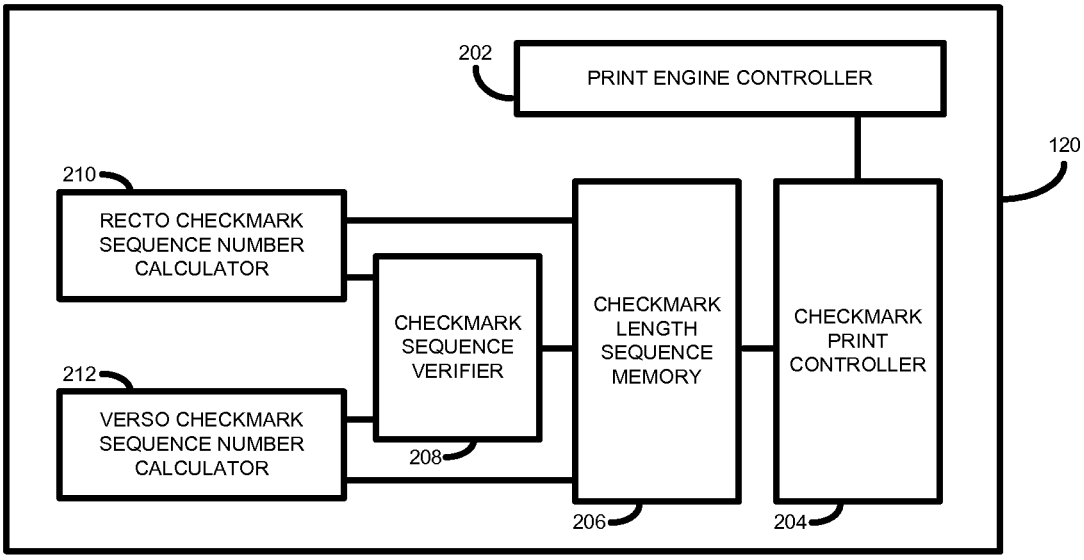
FIG. 2 is a block diagram of a printer controller according to one example.
Figure 3:
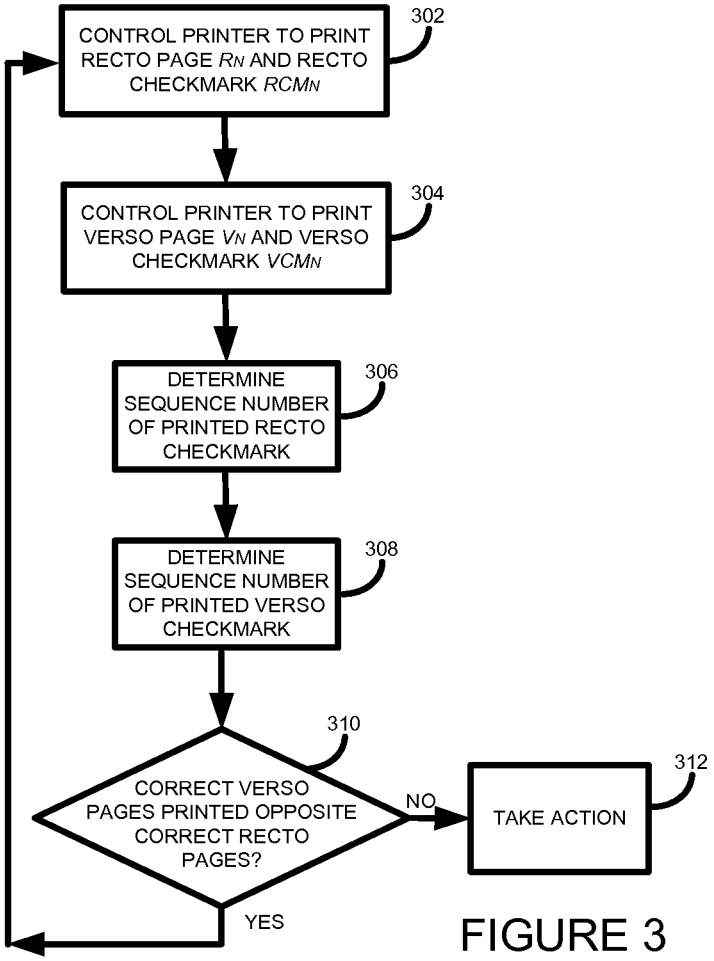
FIG. 3 is a flow diagram outlining a method of operating elements of a printing system according to one example.

FIG. 2 is a block diagram showing the printer controller 120 in greater detail. As shown, the printer controller 120 comprises a print engine controller 202 for generating or sending print engine control data for each page to be printed to the first and second print engines 110 and 114. The print engine controller 202 sends a first data feed of print engine control data to the print engine 110, and a second data feed of print engine control data to the print engine 114. The printer controller 120 further comprises a checkmark print controller 204 to generate control data to cause a checkmark to be printed in association with each page printed by each of the print engines 110 and 114. The printer controller 120 further comprises a memory 206 to store checkmark length sequence data used by the checkmark print controller 204 in generating checkmarks of an appropriate length, as described further below.

In the following description a checkmark printed on a first side of the web 102 by print engine 110 is referred to as a recto checkmark, and a checkmark printed on a second side of the web 102 by print engine 114 is referred to a verso checkmark.

In the present example, the recto and verso checkmarks are two-dimensional checkmarks. In one example, each checkmark is rectangular in shape and has a width and a length. In the present example the checkmarks are printed so they are oriented such that the longest side of the checkmark is parallel to the media advance axis. In one example, the width of the checkmark may be chosen to have a width in the range of about 1 mm to 20 mm. In other examples other checkmark widths may be chosen. The chosen width of the checkmark may be determined, for example, based on characteristics, such as sensor size, of the checkmark readers 116 and 118. As described below, the length of successive checkmarks printed by each print engine 110 and 114 is varied by the printer controller 120 in a predetermined manner in accordance with a predetermined checkmark length sequence.

The printer controller 120 further comprises a recto checkmark sequence number calculator 210 to determine, based on signals received from the checkmark reader 118, a sequence position in the recto checkmark length sequence stored in the memory 206. The printer controller 120 further comprises a verso checkmark sequence number calculator 212 to determine, based on signals received from the checkmark reader 116, a sequence position in the verso checkmark length sequence stored in the memory 206. In one example the checkmark sequence position may be determined by performing a lookup operation in the checkmark length sequence memory.

The printer controller 120 further comprises a checkmark sequence verifier 208 to verify printed checkmarks to determine whether a recto and verso page pair have been correctly printed. By recto and verso page pair is meant a pair of pages (i.e. a recto page and a corresponding verso page) that are intended to be printed on either side of a single sheet of cut media.

The printer controller 120 may, in some examples, comprise additional elements (not shown) such as media advance controllers, user interface controllers, etc.

The print engine controller 202 obtains print engine control data that defines, for each page to be printed, the marks to be made on the media 102 by the print engines 110 and 114. The print engine control data may, for example, be obtained by a raster image processor (RIP), by a software printer driver, or in any other suitable manner.

Operation of elements of the printing system 100 will now be described will further reference to FIGS. 3 to 13.

At block 302 (FIG. 3) the printer controller 120 controls the printing system 100 to cause the first print engine 110 to print a recto page $R_N$ and an associated checkmark $RCM_N$ on the web 102. In one example a checkmark may be printed directly by a print engine by providing thereto checkmark print data. In another example a checkmark may be incorporated directly into a page to be printed, for example by a raster image processing (RIP) or other page processing application.

At block 304 the printer controller 120 controls the printing system 100 to cause the second print engine 114 to print a verso page $V_N$ and an associated checkmark $VCM_N$ on the web 102.

Each recto and each verso page to be printed are assigned a respective sequential sequence number N, and the length of each recto and verso checkmark to be printed by each of the print engines 110 and 114 is determined by the checkmark print controller 204 based on a recto and verso checkmark length sequence stored in the memory 206.

In one example the checkmark length sequence is not stored in a memory but may be generated in real-time by a checkmark length sequence generator.

Figure 4:
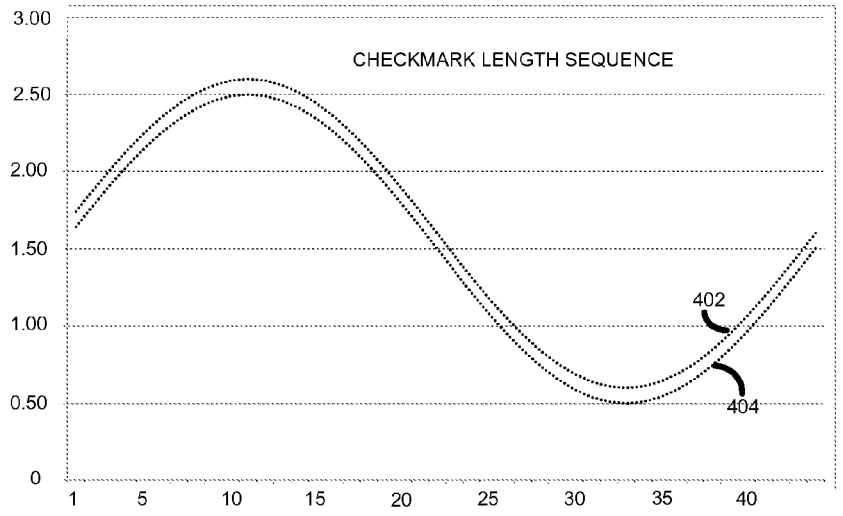
FIG. 4 is an illustration of a checkmark length sequence according to one example.

In the present example the length of each recto and verso checkmark stored in the memory 206 varies respectively in accordance with a first and second sine wave 402 and 404 illustrated in FIG. 4.

In one example the sine wave 402 may, for example, be generated using the function:

$$\sin(f(N))+k$$

Sine wave 404 may, for example, be generated using the function:

$$\sin(f(N))+k+l$$

In the present example sine wave 404 is offset from sine wave 404 by an amount l. In the present example the amplitude of each sine wave 402 and 404 represents the length of each checkmark to be generated. The values of k and l are thus chosen such that the maximum and minimum checkmark lengths are within a predetermined range. In one example, the sine wave generation functions are chosen such that the minimum length of a checkmark is 0.5 mm, and the maximum length of a checkmark is 2.6 mm. In other examples other values may be chosen for the minimum and maximum checkmark lengths. In the present example the offset between the two sine waves is chosen to be around 1 mm. In other examples larger or smaller offsets may be chosen.

In the present example, and as shown in Table 1 below, the length of each checkmark varies in a sinusoidal sequence having a sequence period of length 44. In other examples, a longer or shorter sequence length may be used. In other examples the length of each checkmark may vary in accordance with other continuously varying periodic functions or waves, such as a triangle wave.

TABLE 1

EXAMPLE CHECKMARK LENGTH SEQUENCE

| Page/ Checkmark Sequence No. (N) | Recto Checkmark Length (RCM) | Verso Checkmark Length (VCM) |
|---|---|---|
| 1 | 1.64 | 1.74 |
| 2 | 1.78 | 1.88 |
| 3 | 1.92 | 2.02 |
| 4 | 2.04 | 2.14 |
| 5 | 2.16 | 2.26 |
| 6 | 2.26 | 2.36 |
| 7 | 2.34 | 2.44 |
| 8 | 2.41 | 2.51 |
| 9 | 2.46 | 2.56 |
| 10 | 2.49 | 2.59 |
| 11 | 2.50 | 2.60 |
| 12 | 2.49 | 2.59 |
| 13 | 2.46 | 2.56 |
| 14 | 2.41 | 2.51 |
| 15 | 2.34 | 2.44 |
| 16 | 2.26 | 2.36 |
| 17 | 2.15 | 2.25 |
| 18 | 2.04 | 2.14 |
| 19 | 1.91 | 2.01 |
| 20 | 1.78 | 1.88 |
| 21 | 1.64 | 1.74 |
| 22 | 1.50 | 1.60 |
| 23 | 1.36 | 1.46 |
| 24 | 1.22 | 1.32 |
| 25 | 1.08 | 1.18 |
| 26 | 0.96 | 1.06 |
| 27 | 0.84 | 0.94 |
| 28 | 0.74 | 0.84 |
| 29 | 0.66 | 0.76 |
| 30 | 0.59 | 0.69 |
| 31 | 0.54 | 0.64 |
| 32 | 0.51 | 0.61 |
| 33 | 0.50 | 0.60 |
| 34 | 0.51 | 0.61 |
| 35 | 0.54 | 0.64 |
| 36 | 0.59 | 0.69 |
| 37 | 0.66 | 0.76 |
| 38 | 0.75 | 0.85 |
| 39 | 0.85 | 0.95 |
| 40 | 0.96 | 1.06 |

TABLE 1-continued

| EXAMPLE CHECKMARK LENGTH SEQUENCE | | |
|---|---|---|
| Page/ Checkmark Sequence No. (N) | Recto Checkmark Length (RCM) | Verso Checkmark Length (VCM) |
| 41 | 1.09 | 1.19 |
| 42 | 1.22 | 1.32 |
| 43 | 1.36 | 1.46 |
| 44 | 1.50 | 1.60 |

Figures 5A, 5B, 5C:
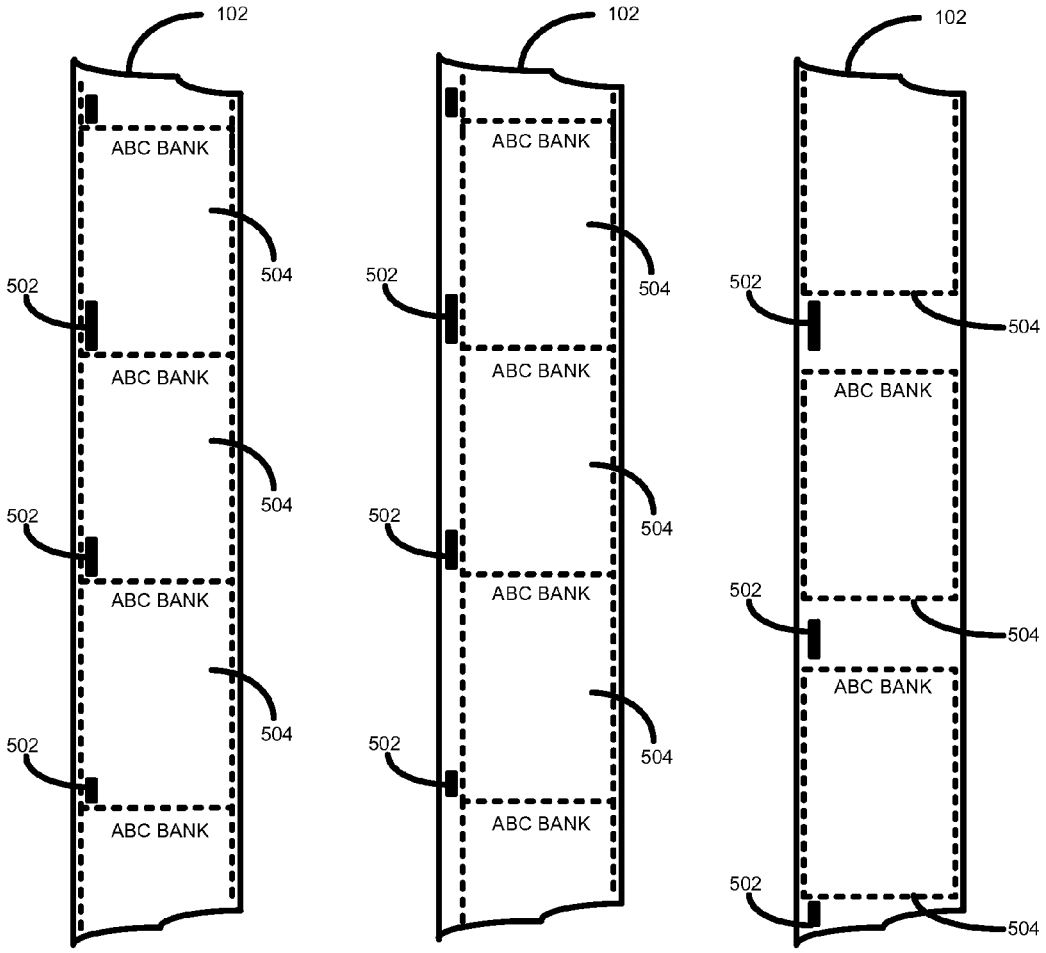
FIG. 5 is an illustration showing where checkmarks may be printed on a web according to one example.

In one example, as illustrated in FIG. 5A, each checkmark 502 is printed within each printed page 504. In one example, as illustrated in FIG. 5B, each checkmark 302 is printed at the side of each printed page 504. In another example, as illustrated in FIG. 5C, each checkmark 502 is printed below each printed page 504.

When the printer controller 120 controls the printing system 100 to print a first recto page (N=1), the checkmark print controller 204 controls the first print engine 110 to print associated recto checkmark $RCM_N$ having length 1.64 mm (see Table 1 above). When the printer controller 120 controls the printing system 100 to print a first verso page (N=1), the checkmark print controller 204 controls the second print engine 114 to print an associated verso checkmark $VCM_N$ having length 1.74 mm.

When the printer controller 120 controls the printing system 100 to print recto page N=2 the checkmark print controller 204 controls the first print engine 110 to print a recto checkmark having length of 1.78 mm. When the printer controller 120 control the printing system 100 to print verso page N=2 the checkmark print controller 204 controls the second print engine 114 to print an associated verso checkmark having length 1.88 mm.

When the printer controller 120 controls the printing system 100 to print recto page N=44 the checkmark length sequence repeats, and the checkmark print controller 204 controls the first print engine 110 to print a recto checkmark having length of 1.64 mm, and controls the second print engine 114 to print a verso checkmark having length 1.74 mm.

In this way, each successive recto checkmark $RCM_N$ varies in length in accordance with the first sine wave 402 and each successive verso checkmark $VCM_N$ varies in length in accordance with the second sine wave 404.

As will be seen further below, varying or modulating the length of successive checkmarks in this manner enables a wide range of synchronization errors between the first and second print engines 110 and 114 to be determined in a simple and fast manner.

In the present example, as shown in FIG. 1, the first and second print engines 110 and 114 are physically distant from one another along the media advance direction. Due to this configuration, each recto and verso page pair of a media sheet are printed at different times and by different print engines. For example, depending on the distance between the two print engines the print engine 110 may be printing a recto page N=50, whereas the print engine 110 may be printing a verso page N=47.

Accordingly, the printer controller 120 has to ensure that the first and second print engine control data sent to each print engine 110 and 114 is suitably synchronized such that pages printed on each side of the web are not only correctly aligned, but also that the correct page is printed on each side of the web. As already mentioned, this ensures that when the web is cut into individual sheets the pages on each side of each sheet are the intended recto and verso page pair.

To verify, however, that the correct recto and verso pages are correctly printed on the media 102 the printer controller 120 determines (blocks 306 and 308, FIG. 3) the sequence number in the corresponding recto and verso checkmark length sequence of the recto and verso checkmarks printed on each side of the media 102. In the present example this is achieved through the first and second checkmark readers 116 and 118 in conjunction with the recto and verso checkmark sequence number calculators 210 and 212.

In the present example the first and second checkmark readers 116 and 118 are arranged to be substantially vertically aligned. In this way each checkmark reader may determine a characteristic of a checkmark substantially simultaneously. In other examples, the first and second checkmark readers 116 and 118 may be arranged in a different configuration.

Figure 6:
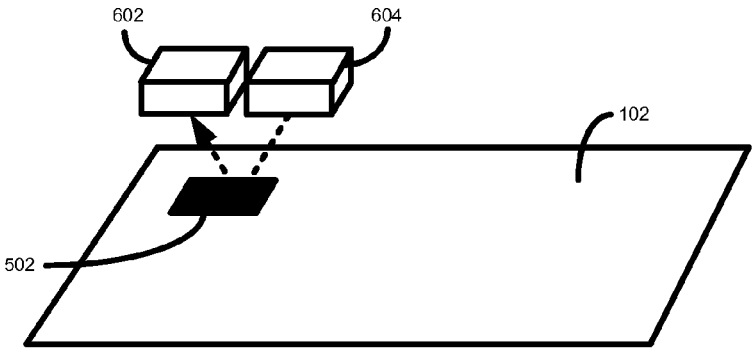
FIG. 6 is an illustration of a checkmark reader according to one example.
Figure 7:
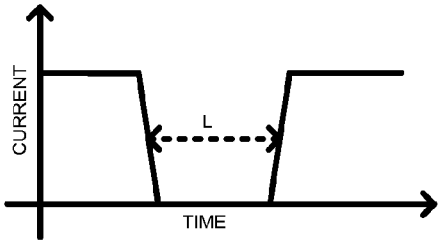
FIG. 7 is an illustration of signals generated by a checkmark reader according to one example.
Figure 8:
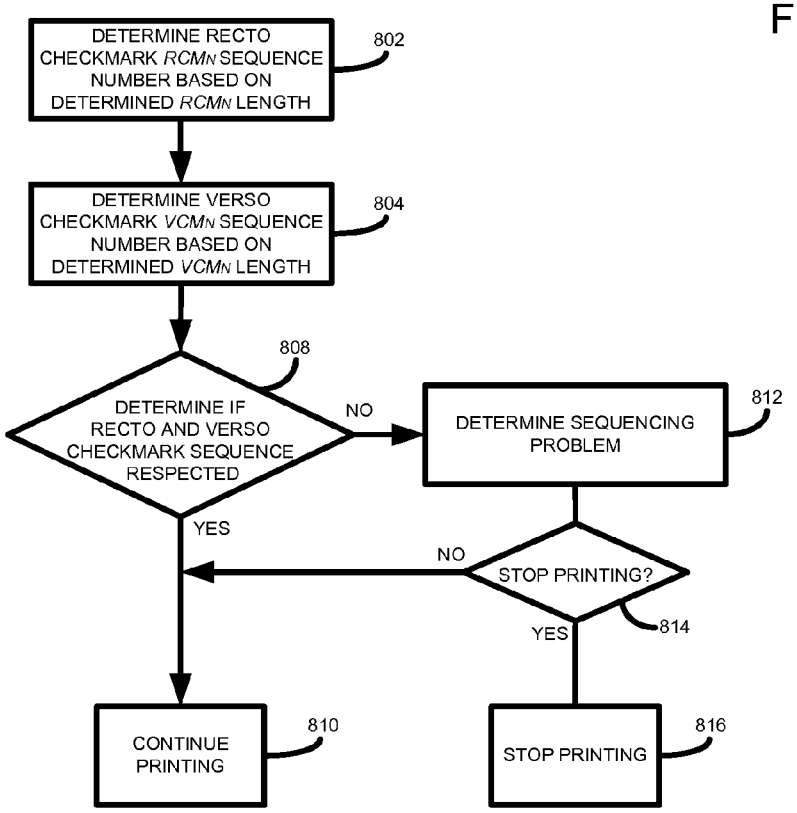
FIG. 8 is a flow diagram outlining a method of operating elements of a printing system according to one example.

In one example, as shown in FIG. 6, each checkmark reader 116 and 118 comprises a light sensor 602 and a light source 604. In one example the light sensor 602 may be a photodiode. The light sensor 602 and light source 604 are positioned in close proximity to the media 102 and in vertical alignment with the checkmarks printed on the media 102. The light source 604 illuminates the checkmarks 502, and the light sensor 602 converts light reflected from the media into an electrical current, as illustrated in FIG. 7.

When the printed checkmark 502 is so positioned in proximity to the light sensor 602 no or little light is reflected from the checkmark and the electrical current generated by the light sensor drops. The duration of this drop in current, as shown in FIG. 7, is directly proportional to the length of the checkmark and the speed at which the media 102 is being advanced.

In examples where checkmarks are printed outside of each printed page, as shown in FIG. 5*b*, the checkmark detection function may operate continuously. In examples where checkmarks are printed in the same lateral position as other printed content within each printed page, for example as shown in FIGS. 5*a* and 5*c*, additional control circuitry may be used to avoid falsely identifying a checkmark. Such additional control circuitry may include, for example, checkmark location identifiers to identify a position in a printed page where a checkmark is expected.

In another example, the light source 604 may be arranged on the opposite side of the web 102 such that light passing through the paper to the sensor is partially or fully blocked by a printed check mark. In another example the printed checkmark 502 may reflect or block non-visible light frequencies such as ultra-violet light.

The signals generated respectively by the each checkmark detectors 116 and 118 are input respectively to the recto checkmark sequence number calculator 210 and the verso checkmark sequence number calculator 212. Each checkmark length sequence number calculator 210 and 212 determines from the input signals the length of each checkmark. In one example the checkmark sequence number calculator (210, 212) calculates the absolute length of each checkmark, for example by additionally obtaining the speed at which the media 102 is advancing. In one example the speed of the media advance is obtained by suitable sensor or media encoder (not shown). From the determined checkmark length, the position in the appropriate checkmark length sequence may be determined. If the determined checkmark length does not correspond within a predetermined degree of accuracy to a stored checkmark length the sequence number N having the length having the closest match may be chosen as the determined sequence number.

By using a simple light sensor, the length of each checkmark is accurately determinable in a simple and fast manner. Advantageously, using such a simple system does not require any complicated or expensive bar code readers and decoders. Furthermore, such a system enables the length of checkmarks to be accurately determined even when the media 102 is moving at high speeds, for example in excess of 100 meters per minute.

At block 310 (FIG. 3) the checkmark sequence verifier 208 determines, based on the determined checkmark sequence numbers, whether the correct verso page is printed opposite the correct recto page. If a negative determination is made the printer controller 120 takes some action (block 312, FIG. 3). In one example the action taken may include one or more of: stopping the printing system; alerting a printing system operator; and taking a corrective action. If an affirmative determination is made, the printing system 100 continues to operate. Further explanation of how the determination is made is given below with additional reference to the flow diagram of FIG. 8.

At blocks 802 and 804 the checkmark sequence verifier 208 determines, based on the determined length, the sequence number N of each the read recto and verso checkmarks. The sequence number N for each recto and verso checkmarks are stored temporarily in a memory (not shown).

At block 808 the checkmark sequence verifier 208 determines whether the checkmark sequence for each of the recto and verso checkmarks has been respected. In one example this may achieved by comparing the determined sequence numbers with the previously determined sequence number, as stored in a memory, for each of the recto and verso checkmarks.

If the checkmark sequence verifier 208 determines that the checkmark sequence has been respected printing continues (block 810).

If, however, the checkmark sequence verifier 208 determines that the checkmark sequence has not been respected it attempts to determine (block 812) what the sequencing problem is.

For example, some sequencing problems may be considered serious enough to warrant stopping the printing system. Such problems may be, for example, where the wrong, or an out-of-sequence, verso page is printed opposite a recto page. Other problems, however, may be considered not serious enough to warrant stopping the printing system. Such problems may be, for example, where a correct recto and verso pair are printed twice in succession.

If, at block 814, the checkmark sequence verifier 208 determines that printing does not need to be stopped then printing may continue (block 810). If, at block 814, the checkmark sequence verifier 208 determines that printing does need to be stopped then the printing system 100 is stopped (block 816).

Figure 9:
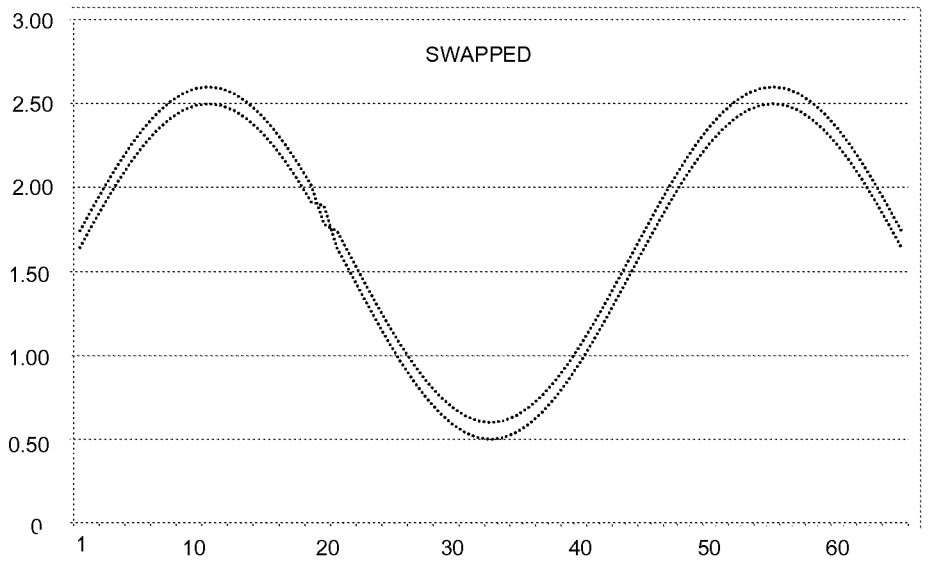
FIGS. 9 to 13 are graphical illustrations of read checkmark lengths according to one example.

FIG. 9 shows a graphical illustration of the read recto and verso checkmark lengths resulting from two pages being swapped—i.e. whether a recto page is printed in the place of a verso page, and vice versa.

Figure 10:
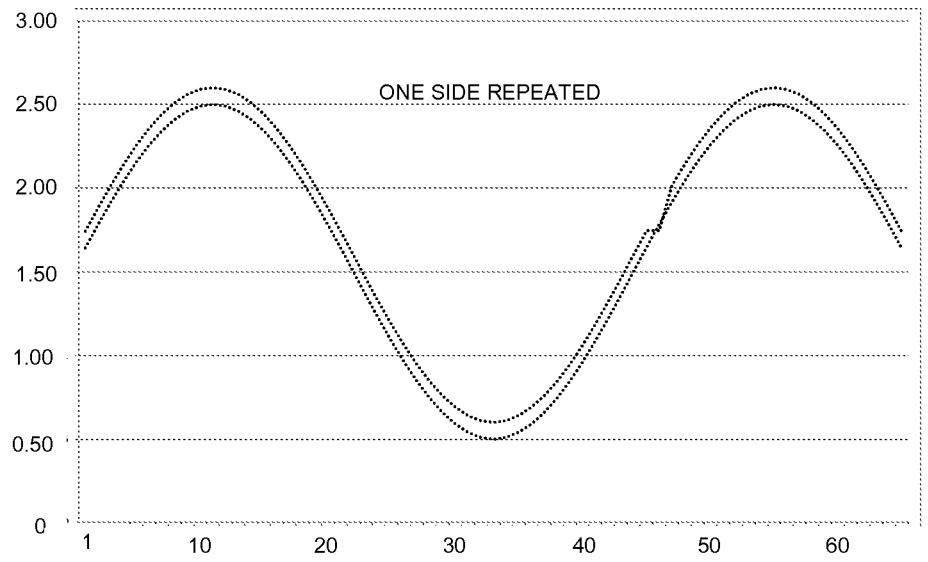

FIG. 10 shows a graphical illustration of the read recto and verso checkmark lengths resulting from of the same recto page being printed twice in succession.

Figure 11:
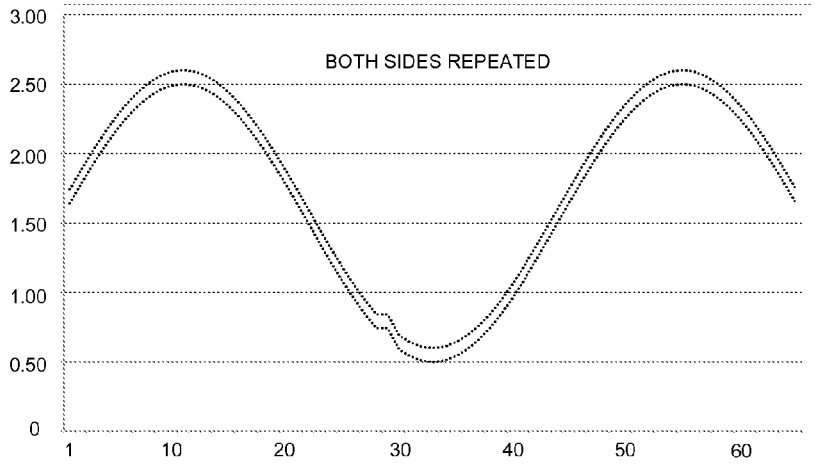

FIG. 11 shows a graphical illustration of the read recto and verso checkmark lengths resulting of the same recto and the same verso page being printed twice in succession.

Figure 12:
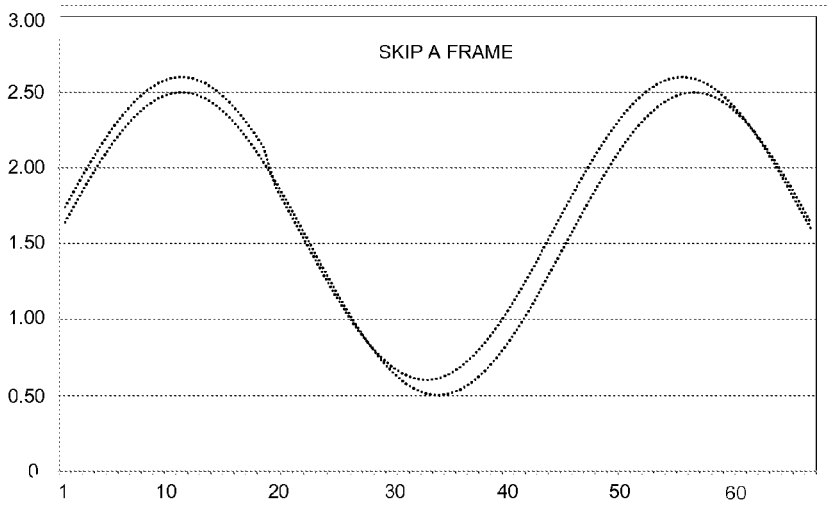

FIG. 12 shows a graphical illustration of the read recto and verso checkmark lengths resulting from a frame being skipped. A frame in this context refers to a recto or a verso page of a recto and verso page pair (or signature).

Figure 13:
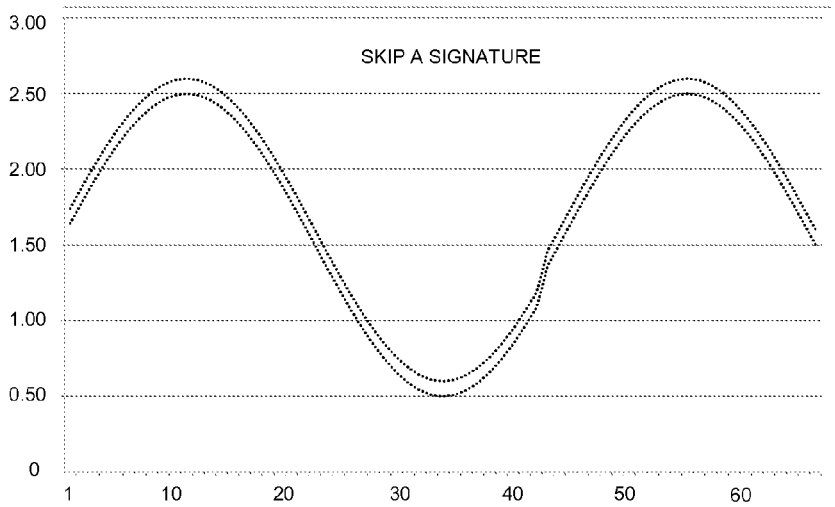

FIG. 13 shows a graphical illustration of the read recto and verso checkmark lengths resulting from a recto and verso page pair (or signature) being skipped.

Although shown as graphical illustrations, the checkmark sequence verifier 208 may determine any of the above synchronization problems by a suitable comparison or calculation based on the read checkmark lengths, determined checkmark sequence numbers, and the checkmark sequences.

Figure 14:
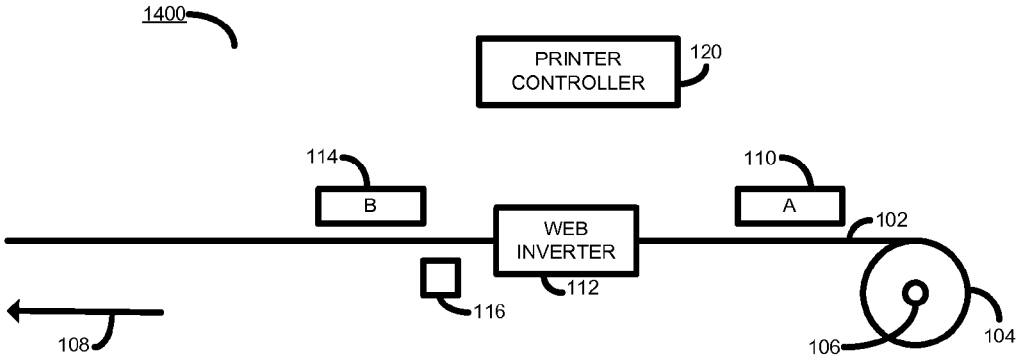
FIG. 14 is a simplified block diagram of a printing system according to one example.
Figure 15:
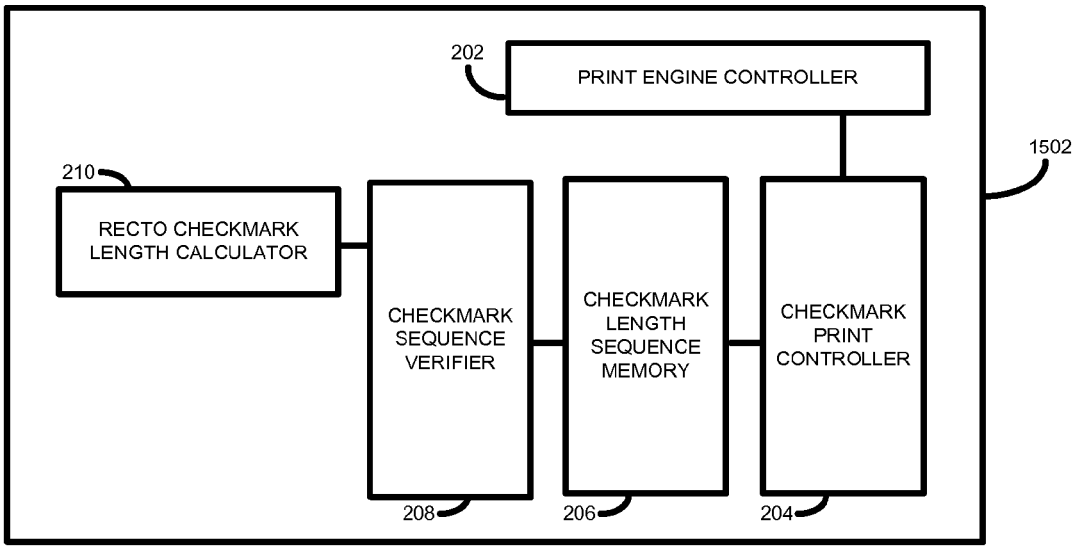
FIG. 15 is a block diagram of a printer controller according to one example.

In a further example, as shown in FIG. 14, a printing system 1400 comprises only a single recto checkmark reader 116 that is positioned intermediate the first and second print engines 110 and 114.

In this example the printer controller 120 determines from the read recto checkmark the sequence number of the printed page in proximity to the recto checkmark reader 118. Prior to printing a verso page the print engine 114 determines whether the sequence number of the page to be printed corresponds to an expected sequence number of the read recto checkmark. If the two sequence numbers correspond, the print engine 114 proceeds to print the page. Otherwise, the print engine 114 may inform the printer controller 120 to stop printing, to alert an operator, or take any other suitable action.

It will be appreciated that examples of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A duplex printing system, comprising:

first and second print engines to respectively print on a first side of a web and a second side of the web;

a controller to:

control the first print engine to print recto pages and associated recto checkmarks;

control the second print engine to print verso pages and associated verso checkmarks; and modify a length of successive printed recto and verso checkmarks in accordance with a respective recto checkmark length sequence and verso checkmark length sequence;

a recto checkmark sequence calculator to determine a sequence position in the recto checkmark length sequence of a printed recto checkmark;

a verso checkmark sequence calculator to determine a sequence position in the verso checkmark length sequence of a printed verso checkmark; and a checkmark sequence verifier to determine print errors based on the determined recto and verso checkmark sequence positions, wherein the recto checkmark length sequence is based on a first continuously varying periodic function, and wherein the verso checkmark length sequence is based on a second continuously varying periodic function.

2. The duplex printing system of claim 1, wherein the recto and verso checkmark sequence calculators each further comprise a checkmark reader to determine the length of a printed checkmark.

3. The duplex printing system of claim 2, wherein the recto and verso checkmark readers each comprise a light sensor to generate an electrical signal in response to an amount of light reflected off or shone through a web.

4. The duplex printing system of claim 1, further comprising a memory to store the recto and verso checkmark length sequences and wherein the recto or verso checkmark sequence calculator is to determine a sequence position in a respective recto or verso checkmark length sequence by performing a lookup in the memory.

5. The duplex printing system of claim 3, wherein the recto and verso checkmark readers are substantially vertically aligned such that the recto and verso checkmarks are read at substantially the same time.

6. The duplex printing system of claim 1, wherein the controller is further configured to perform a predetermined action based on a determined print error.

7. The duplex printing system of claim 1, wherein the first print engine is fed first print engine control data, and wherein the second print engine is fed second print engine control data.

8. The duplex printing system of claim 1, wherein the checkmark sequence verifier is to determine the print errors based on the determined recto and verso checkmark sequence positions and on previously determined recto and verso checkmark sequence positions.

9. A method of duplex printing comprising:

printing recto pages and associated recto checkmarks on a first side of the web, and printing verso pages and associated verso checkmarks on a second side of the web, a length of each successively printed recto checkmark varying in accordance with a recto checkmark length sequence, and a length of each successively printed verso checkmark varying in accordance with verso checkmark length sequence;

determining the length of a respective printed verso checkmark, and determining a sequence position of the respective printed verso checkmark in the verso checkmark length sequence;

determining the length of a respective printed recto checkmark, and determining a sequence position of the respective printed recto checkmark in the recto checkmark length sequence; and determining whether a print error has occurred based on the determined recto and verso checkmark sequence positions, wherein the recto checkmark length sequence is based on a first continuously varying periodic function, and the verso checkmark length sequence is based on a second continuously varying periodic function.

10. The method of claim 9, wherein the step of determining the length of the respective printed verso checkmark and the length of the respective printed recto checkmark are determined substantially simultaneously.

11. The method of claim 9, wherein the determining of the length of the respective printed verso or recto checkmark comprises:

obtaining an electric signal generated by a light sensor in response to light reflected off of shone through the web, and determining a speed of the web.

12. The method of claim 9, further comprising feeding the first print engine with first print engine control data and feeding the second print engine with second print engine control data.

13. The method of claim 9, further comprising taking a predetermined action based on the determined print error.

14. A non-transitory machine-readable storage medium storing instructions that upon execution cause a controller of a print system to:

cause printing of recto pages and associated recto checkmarks on a first side of a web, and cause printing of verso pages and associated verso checkmarks on a second side of the web, a length of each successively printed recto checkmark varying in accordance with a recto checkmark length sequence, and a length of each successively printed verso checkmark varying in accordance with a verso checkmark length sequence;

determine a sequence position of the respective printed verso checkmark in the verso checkmark length sequence;

determine a sequence position of the respective printed recto checkmark in the recto checkmark length sequence; and determine whether a print error has occurred based on the determined recto and verso checkmark sequence positions, wherein the recto checkmark length sequence is based on a first continuously varying periodic function, and the verso checkmark length sequence is based on a second continuously varying periodic function.

* * * * *

UNITED STATES PATENT AND TRADEMARK OFFICE

CERTIFICATE OF CORRECTION

PATENT NO. : 9,126,425 B2
APPLICATION NO. : 14/391719
DATED : September 8, 2015
INVENTOR(S) : Matthew Alan MacClary et al.

It is certified that error appears in the above-identified patent and that said Letters Patent is hereby corrected as shown below:

In column 9, line 45 approx., in Claim 9, delete "the web" and insert -- a web --, therefor.

Signed and Sealed this
Seventh Day of June, 2016

Michelle K. Lee

Michelle K. Lee
*Director of the United States Patent and Trademark Office*